US006079175A

United States Patent [19]

Clear

[11] Patent Number: 6,079,175

[45] Date of Patent: Jun. 27, 2000

[54] CEMENTITIOUS STRUCTURAL BUILDING PANEL

[76] Inventor: Theodore E. Clear, 429 S. Washington Blvd., Hamilton, Ohio 45013

[21] Appl. No.: 08/826,981

[22] Filed: Apr. 9, 1997

[51] Int. Cl.[7] ..... F04B 1/74

[52] U.S. Cl. ..... 52/404.1; 52/439

[58] Field of Search ..... 52/581, 582.1, 52/404.1, 270.1, 417, 422, 429, 439, 441; 249/13, 18

[56] References Cited

U.S. PATENT DOCUMENTS

| | | | |
|---|---|---|---|
| 3,481,093 | 12/1969 | Davidson | 52/426 |
| 3,736,715 | 6/1973 | Krumwiede | 52/309.1 |
| 3,751,867 | 8/1973 | Layne | 52/426 |
| 4,020,611 | 5/1977 | Amos | 52/517 X |
| 4,224,774 | 9/1980 | Peterson | 52/404.1 |
| 4,420,295 | 12/1983 | Clear et al. | 425/92 |
| 4,617,776 | 10/1986 | Bergstrom | 52/690 |
| 4,671,032 | 6/1987 | Reynolds | 52/210 |
| 5,014,476 | 5/1991 | Leslie et al. | 52/220.1 |
| 5,311,718 | 5/1994 | Trousilek | 52/425 |
| 5,519,971 | 5/1996 | Ramirez | 52/220.2 |
| 5,535,565 | 7/1996 | Majnaric et al. | 52/426 |
| 5,678,373 | 10/1997 | Franklin et al. | 52/439 |
| 5,706,620 | 1/1998 | De Zen | 52/220.2 |
| 5,729,944 | 3/1998 | De Zen | 52/439 |

*Primary Examiner*—Beth A. Stephan
*Attorney, Agent, or Firm*—Wood, Herron & Evans LLP

[57] ABSTRACT

A cementitious structural building panel includes two facings made of a mesh reinforced lightweight aggregate core, the facings separated by a plurality of transverse ribs made of the same material and glued to the interior surfaces of the two facings. In use, H-shaped clips are secured to the extending facing edges of each panel so that adjacent panels may be erected and held side-by-side. A flowable material, such as a cementitious fly ash mixture, is poured into the spaces between the ribs and the facings and between the edges of the adjacent panels to form a strong load-bearing multiple panel wall. Once the walls with the panels are erected, the H-shaped clips, which are preferably made of plastic, can be trimmed or shaved off, thereby leaving a smooth or prefinished interior and exterior wall surface which can be readily further finished if desired by the application of paints, stuccos or other facing treatments. Each of the individual building panels is made by applying adhesive to rib edges or to the interior surface of panel edges, applying a plurality of ribs and thereafter applying another facing on the opposite longitudinal edges of the ribs.

14 Claims, 2 Drawing Sheets

CEMENTITIOUS STRUCTURAL BUILDING PANEL

This invention relates to building panels and more particularly to cementitious building panels for use in wall structures of residences and buildings.

BACKGROUND OF THE INVENTION

It is desirable to provide a structural, insulated panel of cementitious material for use in building homes and other buildings. It is important to do so at relatively low cost, and with simple panels easily and inexpensively manufactured. At the same time, it is desirable to provide a building panel and wall structure of high strength and substantial load bearing ability which can easily be erected in remote or barren areas of the world.

SUMMARY OF THE INVENTION

To these ends, a panel and wall structure according to a preferred embodiment of the invention includes a panel comprising two facings and longitudinal vertical ribs glued between the two facings and made of the same material as the facings. Two outermost ribs are inset from the facing edges defining the vertical panel edges. H-shaped clips are used to secure two edge-to-edge panels together by fitting over two adjacent edges. A hardening lightweight fill of cementitious material, i.e. bottom ash, fly ash, cement and water, for example, is then poured into the spaces between the ribs and the facings to provide insulation, strength and rigidity to each panel and to the wall made therefrom. Once the wall is formed and cured, the portions of the clips on the wall surfaces, both sides, can be shaved or trimmed off.

The narrow width ribs are cut from the same material as the facing material and are glued in place singly or in a supported group.

Preferably, the facings and the ribs comprise reinforced cementitious panels comprising a lightweight aggregate core faced on both sides with a mesh bathed in a slurry of neat cement, for example. One such facing panel material is that known as "Util-A-Crete" as manufactured currently by Fin-Pan Inc. of Hamilton, Ohio.

Such structure provides numerous advantages. A very strong, load-bearing wall is formed with either prefinished or ready-to-finish interior and exterior cementitious walls. The fill provides significant insulative qualities and homes and buildings of substantial structure can easily and inexpensively be erected even in remote or barren areas. Such structures have numerous advantages particularly, for example, in so-called third world countries.

Moreover, the problems of disposing of fly ash and bottom ash from various industrial operations are burdensome. This invention provides an environmental and ecological advantage in providing a use for this otherwise waste material.

DETAILED DESCRIPTION OF THE PREFERRED EMBODIMENT

These and other objectives and advantages will be more readily apparent from the following detailed description of a preferred embodiment of the invention and from the drawings, in which.

Figure 1:
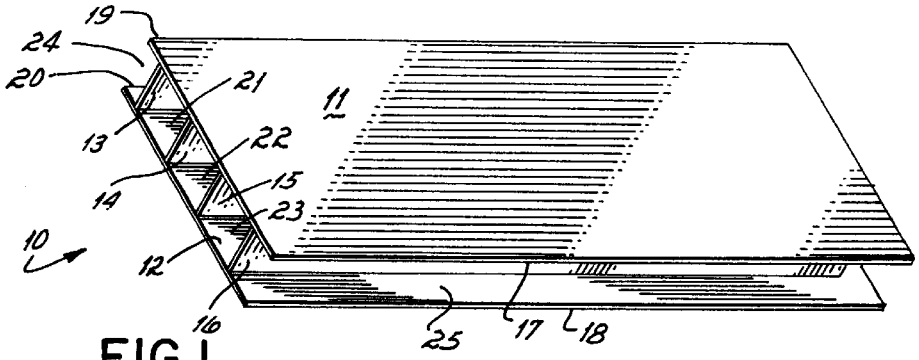
FIG. 1 is a perspective view of a preferred embodiment of a building panel according to the invention.

Turning now to the drawings, there is shown in FIG. 1 a perspective view of a panel 10 according to the invention. The panel 10 includes two facings 11 and 12 joined together and separated by a plurality of ribs 13, 14, 15 and 16. The preferred overall panel 10 is approximately 3 feet wide and 8 feet tall, but panels of any suitable size could be used. In a three foot wide panel, for example, the ribs may be spaced apart on 9 inch centers with the outermost ribs being spaced about 4½ inches from the facing edges.

The outermost ribs 13 and 16 are inset from the opposite parallel edges (vertical when erected) of the panel as shown in FIG. 1. The edges of the panel are defined, for example, by the longitudinal vertical edges 17 and 18 of the facings 11 and 12 respectively. On the other side of the panel the edge of the panel is defined by the respective edges 19 and 20 of the facings of 11 and 12. Accordingly it will be appreciated that the ribs and the panel facings 11, 12 form a plurality of spaces such as 21, 22 and 23 therebetween and as will be described. There is also a space partially defined at 24 and at 25 at the outermost edge of the panel 10.

Figure 3:
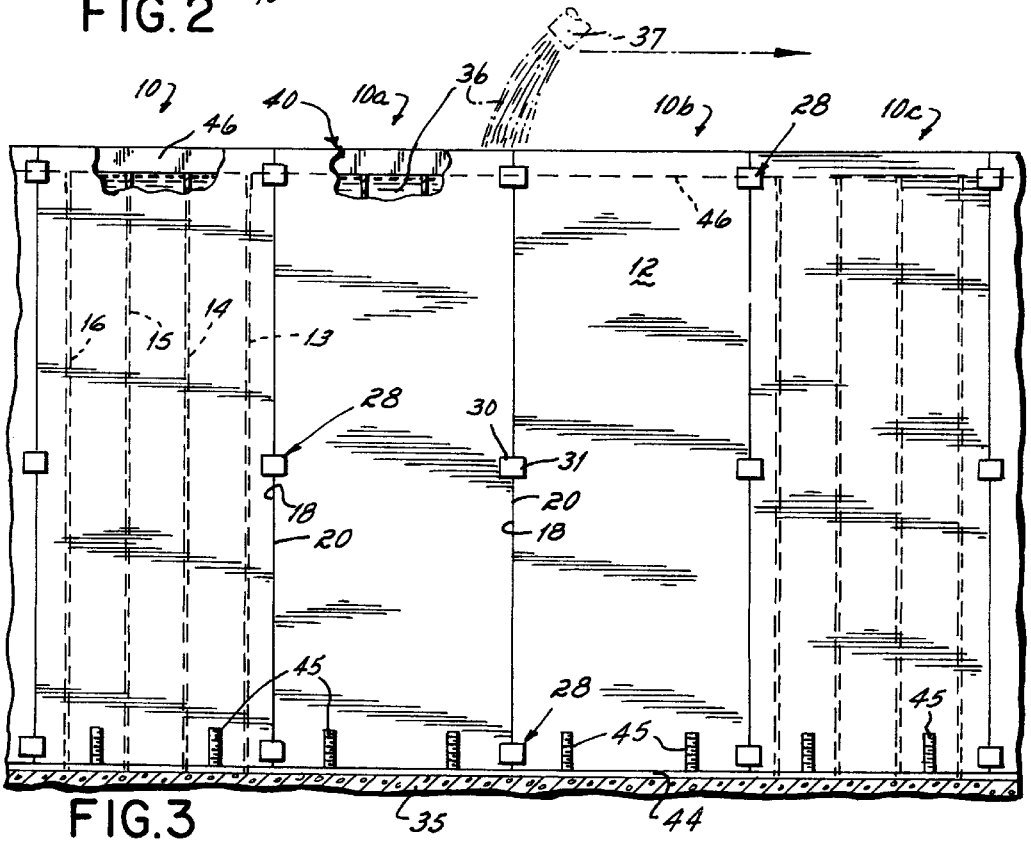
FIG. 3 is an elevational view illustrating a multiple panel wall and the erection thereof.

Preferably, the top of the ribs terminate several inches short of the top of the facings 11, 12 as best seen in FIG. 3. The top of the panel 10 is to the right hand side of FIG. 1.

Figure 2:
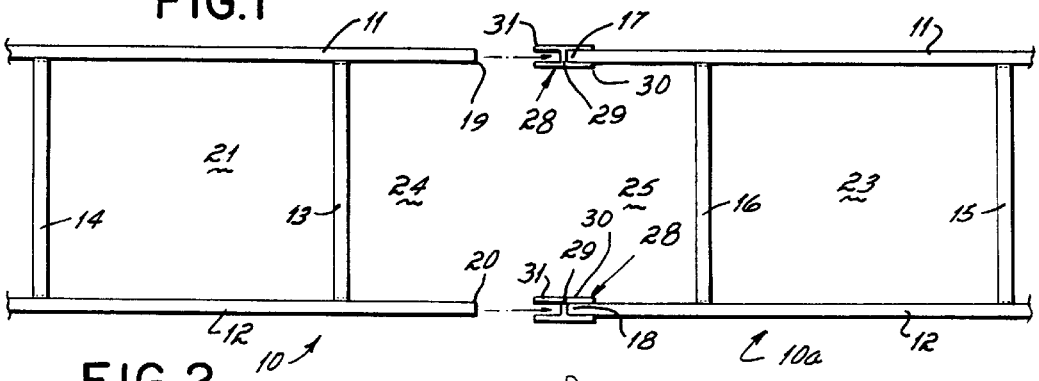
FIG. 2 is a top plan view of two panels as in FIG. 1 disposed side-by-side in a wall format.

Turning now to FIG. 2 it will be appreciated that two panels 10 and 10*a*, such as shown in FIG. 1, are joined together by means of an H-shaped clip or clamp 28. Clip 28 includes a common web 29 and first flange 30 and a second flange 31. In FIG. 2 two such clamps are shown.

The H-shaped nature of these clamps allows them to be fitted over one edge, for example, the edges 19 and 20 of the panel 10 and, as well, over the edges 17, 18 of the panel 10*a* so as to hold the two panels together against particular relative motion backwardly and forwardly against the flanges 30 and 31. In FIG. 2, it will be appreciated that the thickness of each panel 10 and 10*a* is approximately 9 inches, but the panels could be made to any suitable width.

Turning now to FIG. 3 there is illustrated in that figure the erection of a multiple panel wall 40 on a slab or base 35, for example. The panels 10, 10*a*, 10*b* and 10*c* have been erected vertically so that the vertical edges are aligned or held together by clips 28.

Preferably, the panel bottoms are set into a cement-rich grout 44 spread on the concrete base 35 in order to secure the wall 40 to the base. Upstanding channels, rods, bolts, clips or flexible straps or ropes are previously set in the base 35 to engage the panels 10 and hold them in place on the base 35, or to extend upwardly into the hardenable panel fill for the same purpose. Bolts or rods 45 are shown.

Once the panels are so erected, the next step is to pour a lightweight hardenable material 36 from a container hose or other delivery means 37 into the spaces 21, 22, and 23 within each panel and into the adjoining spaces 24, 25 between each panel. Once this material hardens, it will be appreciated that it sets up a very strong and durable structural wall, such as the multiple panel wall 40 shown in FIG. 3. The particular material used is any suitable curable material, preferably cementitious, in a lightweight formulation. One such material comprises equal amounts of fly ash and bottom ash mixed together. An amount of dry cement, at about a similar equal amount, is mixed in and water added. Thus, the mix is about ⅓ equal parts of fly ash, bottom ash and cement with sufficient water added for the hydration process.

The resulting preferred material, when cured, has a compressive strength of about 200 psi. When combined with the facings and ribs, it produces a very strong panel 10. The fill material is then poured preferably up to at least the rib tops.

Once the pouring is complete, a bond beam 46 is preferably set between the facings 11, 12 of all adjoining panels 10, 10*a*, 10*b* and 10*c* to strengthen the top. The elongated bond beam can be wood, or could be formed from cement. And in any event, bolts, rods, or clips (not shown) can be secured to the bond beam to secure a roof structure or additional panels or other structure thereto.

The wall 40 as noted is preferably erected on a concrete base 35 but may be erected on the bare dirt or on any other suitable base or floor. In this regard, rods or other hold-downs are used to secure the panels to the floor.

Figure 4:
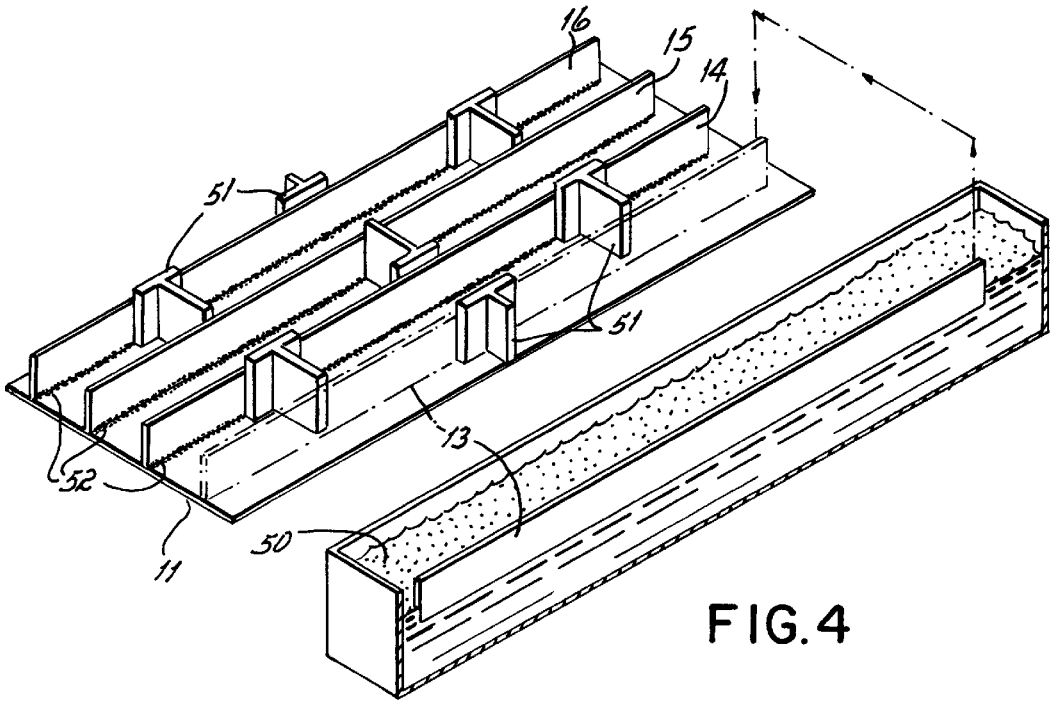
FIGS. 4, 5 and 6 are diagrammatic views illustrating assembly of the panel of FIG. 1.

Turning now to FIG. 4 there is illustrated therein the manufacture of a panel, such as panel 10, in FIG. 1. In FIG. 4, a first facing 11 is preferably disposed on a conveyance means (not shown) and moved along an assembly line.

Thereafter adhesive is either applied to the upper surface of the panel facing 11 or to the longitudinal edges of various ribs to be secured thereto. Preferably, the ribs have their long edge dipped in an adhesive such as a mix 50 of cement, fly ash and polymer such as latex. Thereafter, the ribs 13–16 are applied by means of a jig. "T"-shaped support 51 or other suitable aligning device to the facing 11. The adhesive flows down the ribs faces and forms a weld-like fillet 52 at the junction to facing 11.

Figure 5:
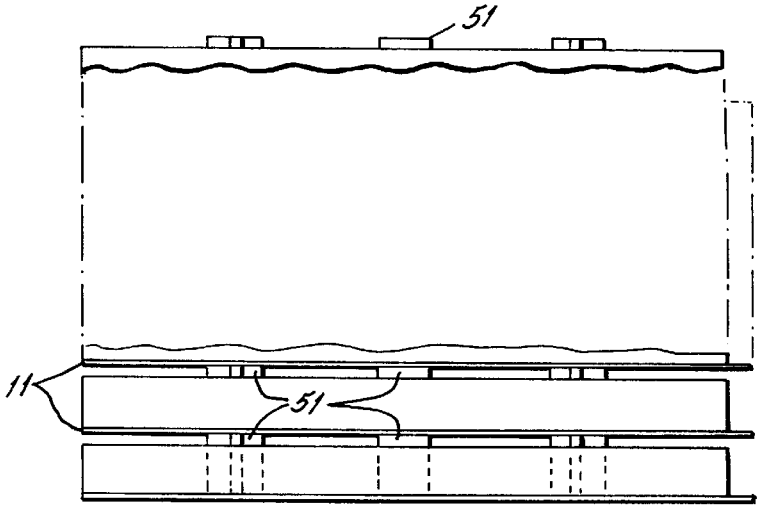
Figure 6:
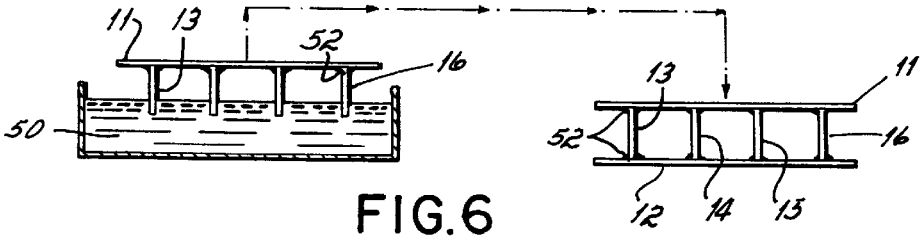

Thereafter, wooden jigs or hold-ups 51 are used to support the ribs in position. These supports 51 extend from the facing 11 at least slightly above the ribs so other facings 11 with ribs can be stacked thereon (as shown in FIG. 5). Once cured as shown in FIG. 6, the facing 11 with ribs is inverted, dipped in similar adhesive 50 and then applied to a facing 12 to complete the panel. Adhesive runs down the ribs to form a weld-like fillet 52 between the ribs and the facing 12. In the alternative, of course, adhesive could have been supplied to the interior surface of the upper facing 12. Panels are stacked for curing. Jigs or supports (not shown) may be used if necessary to align or support the stacked panels or their components for curing.

In this manner, the cured facings 11, 12 are secured together by means of the intermediate ribs which also comprise material similar to that in the facings 11, 12.

More particularly, such material constitutes a lightweight aggregate mesh reinforced panel of the type marketed under the trademark "Util-A-Crete" by Fin Pan Inc. of Hamilton, Ohio. Such panels include a lightweight aggregate core faced on both sides with a reinforced mesh and, in particular, a glass-like mesh which has been run through a slurry bath of neat cement and thereafter applied by compaction to the face of the lightweight aggregate core. Such panels are more particularly described in the following U.S. Patent Numbers: U.S. Pat. No. Re. 31,921; U.S. Pat. No. Re. 32,038; U.S. Pat. No. Re. 32,037; U.S. Pat. Nos. 3,284,980 and 4,420,295, all of which are expressly incorporated herein by reference. Any other suitable cementitious panel might be utilized.

Preferably such panels are moisture-pervious. This is helpful to wicking away water from the curing or hydration process of the cementitious fill material in the erected panels.

It will also be appreciated that the fill material 36 will harden in place after the material is poured or flowed into the various spaces in order to set up and substantially strengthen any wall structures made by the panels and, as well, the junctions between the panels.

It will also be appreciated that many other improvements or modifications can be made to the panel for use in either residential or other applications. Wires can be run in the various spaces prior to filling with the cementitious material 36. Ducting provisions can be made in the panels using the rib-formed passages or duct work inserted therein. Other changes can be made. For example, the panels may be filled and/or oriented horizontally so as to make room for a wide window or windows can be cut out of the panel materials, as can be the various doors leading into and out of rooms formed by the multiple panel walls, or to the exterior.

Also, it will be appreciated that various clips or other devices can be used to secure the tops of the panels to any suitable roof structure, while the bottoms of the panels can be secured to a base or floor by means other than as disclosed herein.

These and other advantages and modifications will be readily apparent to those of ordinary skill in the art without departing from the scope of this invention and the applicant intends to be bound only by the claims appended hereto:

What is claimed is:

1. A wall panel comprising:

a first facing comprising a reinforced mesh cementitious panel including mesh surfaces and an aggregate cementitious core;

a second facing comprising a reinforced mesh cementitious panel including mesh surfaces and an aggregate cementitious core;

said first and second facings disposed in separate planes and defining respective interior surfaces facing each other;

a plurality of ribs extending transversely between said facings holding said facings together and defining vertical spaces therebetween, at least two of said ribs comprising outermost ribs;

said ribs comprising a reinforced mesh cementitious panel including mesh surfaces and an aggregate cementitious core; and said ribs having edges engaging and adhered to the respective interior surfaces of said facings.

2. The wall panel as in claim 1 wherein respective outermost ribs between said facings are set in from sides of said panel such that said facings extend horizontally beyond the outermost ribs on each side of said panel.

3. The wall panel as in claim 2 wherein said panel has a bottom end and a top end and said ribs extend to a bottom end of the panel and terminate short of said top end of the panel.

4. A wall structure comprising a plurality of wall panels wherein each panel comprises:

a first facing comprising a reinforced mesh cementitious panel including mesh surfaces and an aggregate cementitious core;

a second facing comprising a reinforced mesh cementitious panel including mesh surfaces and an aggregate cementitious core;

said first and second facings disposed in separate planes and defining respective interior surfaces facing each other;

a plurality of ribs extending transversely between said facings holding said facings together and defining vertical spaces therebetween;

said ribs comprising a reinforced mesh cementitious panel including mesh surfaces and an aggregate cementitious core; and said ribs having edges engaging and adhered to the respective interior surfaces of said facings.

5. The wall structure as in claim 4 wherein each panel has a vertical edge defined by side edges of said facings and further including a plurality of H-shaped clips engaging edges of each panel facing and holding said panels together in a wall.

6. The wall structure as in claim 5 further including a hardened fill material residing in said vertical spaces between said facings and said ribs.

7. The wall structure as in claim 6 said panels having respective top ends, said facings having upper portions proximate said top end, respectively, and the wall structure further including a bond beam extending across the top ends of adjacent panels between an upper portion of opposite facings of each panel.

8. A method of erecting a wall comprising a plurality of wall panels wherein each panel comprises a first facing comprising a reinforced mesh cementitious panel including mesh reinforced surfaces and an aggregate cementitious core; a second facing comprising a reinforced mesh cementitious panel including mesh surfaces and an aggregate cementitious core; said first and second facings disposed in separate planes and defining respective interior surfaces facing each other; a plurality of ribs extending transversely between said facings holding said facings together and defining vertical spaces therebetween; said ribs comprising a reinforced mesh cementitious panel including mesh reinforced surfaces and an aggregate cementitious core; and said ribs having edges engaging and adhered to the respective interior surfaces of said facings said panels having adjacent edges for interconnection; said method comprising the steps of:

inserting H-shaped clips on the edges of one of said vertical panels;

moving a second of said panels into edge-to-edge adjacent relation with the one panel, with said clip engaging edges of both said panels and in such a position as to define a space between said two panels; and introducing a hardenable fill material into the spaces between said ribs and facings of each panel and into a space between each of said panels to form said wall.

9. The method as in claim 8 wherein a portion of a clip resides on an interior surface of said wall and including the further step of shaving off that portion of said clip residing on said interior surface of said wall.

10. The method as in claim 8 wherein said panels each have a top defined between facings thereof and including the step of placing a bond beam across the tops of adjacent panels and between the opposite facings of the panels.

11. The method as in claim 8 including the step of setting said panels into a cementitious grout on a base.

12. A method of making a cementitious panel comprising a first facing comprising a reinforced mesh cementitious panel including mesh surfaces and an aggregate cementitious core; a second facing comprising a reinforced mesh cementitious panel including mesh surfaces and an aggregate cementitious core; said first and second facings disposed in separate planes facing each other; a plurality of ribs extending transversely between said facings holding said facings together and defining vertical spaces therebetween; said ribs comprising a reinforced mesh cementitious panel including mesh surfaces and an aggregate cementitious core; and said ribs having edges adhered to the respective interior surfaces of said facings, said method including the step of:

applying adhesive to one of an interior surface of one of said facings and longitudinal edges of said ribs;

adhering said ribs to said interior surface;

applying adhesive to one of an interior surface of the other said facings and opposite longitudinal edges of said ribs; and adhering said second facing to said ribs;

thereby forming a panel of two facings and transverse ribs, all formed from the same facing material and defining longitudinal vertical spacings in said panel between said facings and said ribs.

13. The method as in claim 12 including the steps of:

dipping edges of said ribs in adhesive;

applying said ribs to said interior surface of said one facing and holding said ribs for curing of said adhesive;

then inverting said ribs and said one facing;

dipping opposite edges of said ribs in adhesive;

applying said opposite edges of said ribs to said interior surface of said second facing; and curing said adhesive to form said panel.

14. The method as in claim 13 including supporting said ribs on said interior surface of said one facing with supports extending above said ribs and stacking additional single facings with ribs thereon, one such additional facing being disposed atop the supports extending from a lower facing.

* * * * *